US007597798B2

(12) United States Patent
Feimer et al.

(10) Patent No.: US 7,597,798 B2
(45) Date of Patent: Oct. 6, 2009

(54) METHOD FOR REDUCING THE AMOUNT OF HIGH MOLECULAR WEIGHT ORGANIC SULFUR PICKED-UP BY HYDROCARBON STREAMS TRANSPORTED THROUGH A PIPELINE

(75) Inventors: Joseph L. Feimer, Bright's Grove (CA); Bal K. Kaul, Fairfax, VA (US); Lawrence J. Lawlor, Camlachie (CA); Jeenok T. Kim, Fairfax, VA (US); G. Bryce McGarvey, Sarnia (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 285 days.

(21) Appl. No.: 11/155,281

(22) Filed: Jun. 17, 2005

(65) Prior Publication Data

US 2006/0283779 A1 Dec. 21, 2006

(51) Int. Cl.
*C10G 45/04* (2006.01)
*C10G 25/00* (2006.01)
*C10G 45/60* (2006.01)

(52) U.S. Cl. ..... 208/213; 208/208 R; 208/299; 208/310 Z; 502/250; 502/252

(58) Field of Classification Search ..... 208/208 R, 208/213, 299, 310 Z; 502/250, 252
See application file for complete search history.

(56) References Cited

U.S. PATENT DOCUMENTS

| | | | | |
|---|---|---|---|---|
| 4,011,882 | A | 3/1977 | Nivens et al. | |
| 4,149,966 | A | 4/1979 | O'Donnell et al. | |
| 5,199,978 | A | 4/1993 | Poirier et al. | |
| 5,360,536 | A | 11/1994 | Nemeth et al. | |
| 5,611,914 | A | 3/1997 | Prince et al. | |
| 5,618,408 | A | 4/1997 | Poirier et al. | |
| 5,807,475 | A * | 9/1998 | Kulprathipanja et al. | 208/208 R |
| 6,159,256 | A | 12/2000 | Bonville, Jr. et al. | |
| 6,210,821 | B1 | 4/2001 | Lesieur et al. | |
| 6,346,190 | B1 | 2/2002 | Khare | |
| 6,544,410 | B1 | 4/2003 | Gislason et al. | |
| 6,635,795 | B2 | 10/2003 | Gislason et al. | |
| 6,649,555 | B2 | 11/2003 | Dodwell et al. | |
| 6,656,877 | B2 | 12/2003 | Sughrue et al. | |
| 6,683,024 | B1 | 1/2004 | Khare et al. | |
| 2002/0018853 | A1 | 2/2002 | Khare | |

(Continued)

FOREIGN PATENT DOCUMENTS

| | | |
|---|---|---|
| CA | 2 370 627 | 3/2001 |

(Continued)

OTHER PUBLICATIONS

Salem, Abu Bakr S. H.; Hamid, Halim S; "Removal of Sulfur Compounds from Naphtha Solutions Using Solid Adsorbents," Chem. Eng. Technol. 20 (1997) 342-347.

*Primary Examiner*—Glenn Caldarola
*Assistant Examiner*—Prem C. Singh

(57) ABSTRACT

A process for removing relatively low levels of high molecular weight organic sulfur from hydrocarbon streams, particularly from streams that have picked-up such sulfur while being transported through a pipeline. The hydrocarbon stream containing the organic sulfur is passed through a bed of adsorbent material comprised of a high Ni content, high surface area material that also contains an effective amount of $SiO_2$ or $GeO_2$ and an alkaline earth metal.

11 Claims, 8 Drawing Sheets

Effect of Adsorbent Type on Sulfur Equilibrium Capacity

U.S. PATENT DOCUMENTS

| | | | |
|---|---|---|---|
| 2002/0147110 | A1 | 10/2002 | Dodwell et al. |
| 2003/0106841 | A1 | 6/2003 | Zong et al. |
| 2003/0114299 | A1 | 6/2003 | Khare |
| 2003/0118495 | A1 | 6/2003 | Khare et al. |
| 2003/0166564 | A1 | 9/2003 | Besner et al. |
| 2003/0183802 | A1 | 10/2003 | Price et al. |
| 2003/0183803 | A1 | 10/2003 | Price et al. |
| 2003/0188993 | A1 | 10/2003 | Khare et al. |
| 2003/0203815 | A1 | 10/2003 | Khare et al. |
| 2004/0004029 | A1 | 1/2004 | Khare et al. |
| 2004/0007130 | A1 | 1/2004 | Gislason et al. |
| 2004/0007498 | A1 | 1/2004 | Gislason et al. |
| 2004/0007505 | A1 | 1/2004 | Meier et al. |
| 2004/0007506 | A1 | 1/2004 | Song et al. |
| 2004/0031730 | A1 | 2/2004 | Gislason et al. |
| 2004/0038816 | A1 | 2/2004 | Morton et al. |
| 2004/0040887 | A1 | 3/2004 | Simon et al. |
| 2004/0040890 | A1 | 3/2004 | Morton et al. |
| 2004/0048743 | A1 | 3/2004 | Malandra et al. |
| 2004/0063576 | A1 * | 4/2004 | Weston et al. ..... 502/250 |
| 2004/0063578 | A1 | 4/2004 | Morton et al. |
| 2004/0118747 | A1 | 6/2004 | Cutler et al. |
| 2004/0120875 | A1 | 6/2004 | Morton et al. |
| 2004/0121906 | A1 | 6/2004 | Gislason et al. |
| 2004/0129607 | A1 | 7/2004 | Slater et al. |
| 2004/0140244 | A1 | 7/2004 | Sughrue et al. |

FOREIGN PATENT DOCUMENTS

| | | |
|---|---|---|
| CA | 2 385 267 | 5/2001 |
| CA | 2 387 986 | 5/2001 |
| CA | 2 393 398 | 6/2001 |
| CA | 2 404 643 | 12/2001 |
| CA | 2 420 338 | 3/2002 |
| WO | WO 00/39252 | 7/2000 |
| WO | WO 01/46341 A1 | 6/2001 |
| WO | WO 01/62871 A1 | 8/2001 |
| WO | WO 02/21623 A1 | 3/2002 |
| WO | WO 02/070109 A1 | 9/2002 |

* cited by examiner

Effect of Adsorbent Type on Sulfur Equilibrium Capacity

Sulfur in Treated Product Versus Feed-to-Adsorbent Ratio
for Adsorbent A and Adsorbent E Effect of Sulfur Type on Sulfur Breakthrough Curve Impact of Temperature Ramping on $H_2$ Production Comparison of Heavy Organic Sulfur Uptake for Constant Temperature and Temperature Ramping Operation Shows Impact of Adsorber Operating Temperature on Sulfur Capacity Relative to 300°C Product Sulfur Breakthrough for 225°C Operation Product Sulfur Breakthrough for Temperature Ramping Operation

METHOD FOR REDUCING THE AMOUNT OF HIGH MOLECULAR WEIGHT ORGANIC SULFUR PICKED-UP BY HYDROCARBON STREAMS TRANSPORTED THROUGH A PIPELINE

FIELD OF THE INVENTION

This invention relates to a process for removing relatively low levels of high molecular weight organic sulfur from hydrocarbon streams, particularly from streams that have picked-up such sulfur while being transported through a pipeline. The hydrocarbon stream containing the organic sulfur is passed through a bed of adsorbent material comprised of a high Ni content, high surface area material that also contains an effective amount of $SiO_2$ or $GeO_2$ and an alkaline earth metal oxide.

BACKGROUND OF THE INVENTION

The total sulfur in gasoline after 2005 will be limited to less than 30 wppm, while the total sulfur in diesel after 2006 will be limited to a maximum of 15 wppm. Various refinery processes, such as hydrodesulfurization, are commercially used to produce refined hydrocarbon streams that meet these low sulfur requirements. Unfortunately, a substantial fraction of these refined streams are transported via a pipeline that is also used for transporting high sulfur content crude and other sulfur-containing petroleum streams. When low sulfur transportation fuels are transported through such a pipeline they often pick-up unacceptable levels of both elemental sulfur and organic sulfur, some of which are relatively high boiling materials. This sulfur contamination can occur not only from crude carry-over, but also from cross-contamination between different refined streams. For example, a jet fuel containing up to about 3,000 wppm sulfur can contaminate low sulfur gasoline and distillate product streams. When the refined low sulfur product stream reaches a distribution terminal at the end of the pipeline, it will often contain a level of sulfur compounds that is too high to meet governmental regulations, and thus the stream must undergo an additional step to remove sulfur moieties to an acceptable level. Although the exact mechanism for sulfur pick-up is unknown, it is believed that reactive sulfur molecules from crude or high sulfur-containing product streams adsorb on the pipeline walls during the crude or high sulfur product cycles. These sulfur molecules will then desorb into the ultra-low sulfur product streams during the ultra-low sulfur product cycles in the pipeline delivery sequences.

Various techniques have been reported for removing both elemental and organic sulfur from petroleum product streams, including conventional high severity hydrodesulfurization in the presence of a Group VIII/Group VI supported catalyst and hydrogen. Also, U.S. Pat. No. 4,149,966 discloses a method for removing elemental sulfur from refined hydrocarbon streams by adding an organo-mercaptan compound plus a copper compound capable of forming a soluble complex with the mercaptan and sulfur. The stream is then contacted with an adsorbent material to remove the resulting copper complex and substantially all elemental sulfur.

U.S. Pat. No. 4,011,882 discloses a method for reducing sulfur contamination of refined hydrocarbon streams transported in a pipeline for the transportation of sweet and sour hydrocarbon streams by washing the pipeline with a wash solution containing a mixture of light and heavy amines, a corrosion inhibitor, a surfactant and an alkanol containing from 1 to 6 carbon atoms.

U.S. Pat. No.5,618,408 teaches a method for reducing the amount of sulfur and other sulfur contaminants picked-up by refined hydrocarbon products, such as gasoline and distillate fuels, that are shipped in a pipeline used to transport heavier sour hydrocarbon product streams. The method involves controlling the level of dissolved oxygen in the refined hydrocarbon stream that is to be pipelined.

Further, U.S. Pat. No. 5,199,978 teaches the use of an inorganic caustic material, an alkyl alcohol, and an organo mercaptan, or sulfide compound, capable of reacting with elemental sulfur to form a fluid-insoluble polysulfide salt reaction product at ambient temperatures.

Adsorption is often a cost-effective process to remove relatively low levels of contaminants. Salem, A. B. et al., "Removal of Sulfur Compounds from Naphtha Solutions Using Solid Adsorbents", Chemical Engineering and Technology, Jun. 20, 1997, report a 65% reduction in the sulfur level (500 to 175 wppm) for a 50/50 mixture of virgin and cracked naphthas using activated carbon at 80° C. and a 30% reduction using Zeolite 13X at 80° C. Also, U.S. Pat. No. 5,807,475 teaches that Ni or Mo exchanged Zeolite X and Y can be used to remove sulfur compounds from hydrocarbon streams. Typical adsorption processes have an adsorption cycle whereby the contaminant is adsorbed from the stream followed by a desorption cycle whereby the adsorbent is regenerated by removing at least a portion, preferably substantially all, of the contaminants therefrom. Also, conventional bulk nickel adsorbents have been used to remove trace amounts of sulfur from naphtha streams. Such conventional bulk nickel adsorbents are only typically suitable for removing low levels of light mercaptan sulfur and do not have enough sulfur capacity to remove high molecular weight organic sulfur from distillate streams.

While such methods have met with varying degrees of success, there still exists a need in the art for reducing both elemental and organic sulfur pick-up by hydrocarbon product streams when transported through a pipeline. For example, high molecular weight sulfur species can be removed from such transported streams using conventional high severity hydrodesulfurization, the operating cost can be substantial. Therefore, there is a need in the art for technology that is capable of removing relatively low levels of high molecular weight sulfur compounds from hydrocarbon streams and at relatively low operating costs.

SUMMARY OF THE INVENTION

In an embodiment, there is provided a process for removing high molecular weight organic sulfur species having a molecular weight of 200 and higher, from hydrocarbon streams by passing said hydrocarbon stream through a bed of adsorbent material, which adsorbent material has a Ni content from about 50 wt. % to about 90 wt. %, from about 5 to 20 wt. % of an oxide selected from $SiO_2$ and $GeO_2$, from about 1 to 10 wt. % of an alkaline-earth metal oxide, wherein all weight percents are based on the total weight of the adsorbent, and which adsorbent has a BET surface area of about 200 $m^2/g$ to about 400 $m^2/g$ and a nickel surface area greater than 20 $m^2/g$ based on dynamic $H_2$ chemisorption.

In another embodiment the Ni-containing adsorbent contains an effective amount of an alkaline-earth metal oxide.

In yet another preferred embodiment the alkaline-earth metal oxide is MgO.

In still another preferred embodiment the Ni-containing adsorbent contains an effective amount of $SiO_2$ and an alkaline-earth metal oxide.

DETAILED DESCRIPTION OF THE INVENTION

Figure 1:
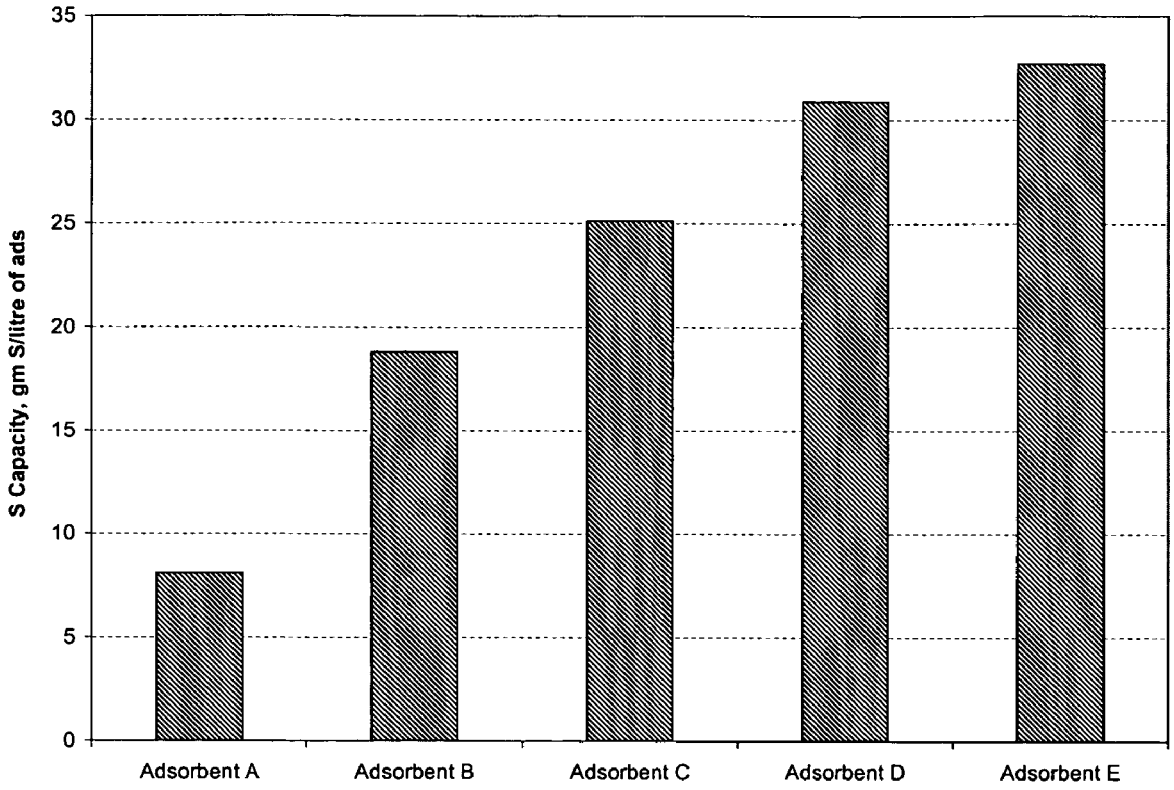
FIG. 1 hereof is a bar chart showing the effects of adsorbent type of sulfur equilibrium capacity.

The present invention comprises a method for reducing the amount of sulfur compounds in hydrocarbon feedstreams, preferably petroleum feedstreams boiling from about the naphtha (gasoline) range, to the distillate boiling range and more particularly those streams that have been transported through a pipeline. Naphtha boiling range streams can comprise any one or more refinery streams boiling in the range from about 10° C. to about 230° C., at atmospheric pressure. A naphtha boiling range stream usually contains cracked naphtha, such as fluid catalytic cracking unit naphtha (FCC catalytic naphtha, or cat cracked naphtha), coker naphtha, hydrocracker naphtha, resid hydrotreater naphtha, debutanized natural gasoline (DNG), and gasoline blending components from other sources from which a naphtha boiling range stream can be produced. FCC catalytic naphtha and coker naphtha are generally more olefinic naphthas since they are products of catalytic and/or thermal cracking reactions. The sulfur content of a cat cracked naphtha stream will generally range from about 500 to about 7000 wppm, more typically from about 700 to about 5000 wppm, based on the total weight of the feedstream. Non-limiting examples of hydrocarbon feedstreams boiling in the distillate range include diesel fuels, jet fuels, heating oils, and lubes. Such streams typically have a boiling range from about 150° C. to about 600° C., preferably from about 175° C. to about 400° C. All such feedstreams must be hydrodesulfurized to bring the sulfur levels down to commercially recognized levels, typically less than about 50 wppm or lower. These streams are often transported through a pipeline used to carry a wide variety of chemical and petroleum materials, some of which not only have a very high sulfur content, but also contain high molecular weight organic sulfur compounds not typically found in naphtha and distillate streams because of their high boiling points. When naphtha and distillate product streams are transported through such a pipeline, particularly when the last previous stream transported contained a significant level of high molecular weight organic sulfur compounds, the naphtha or distillate stream will often "pick up" enough of these high molecular weight sulfur compounds to push the product steam above government sulfur regulations. Organic sulfur pick-up is typically any non-elemental sulfur component in the hydrocarbon stream that was not present in the stream prior to introducing the stream into the pipeline. High molecular weight organic sulfur compounds are those that typically have a molecular weight of about 200 to about 10,000 and a boiling point of at least about 300° C. Such high molecular weight sulfur compounds include mercaptans, sulphides, polysulphides and condensed multi-ring dibenzothiophenes. Consequently, this additional amount of sulfur needs to be removed before the product stream is put on the market. While conventional hydrodesulfurization process can be used to remove this additional sulfur, the cost can be prohibitive given the nature of the sulfur molecules and their low levels in the product stream. One of the benefits of the process of the present invention versus conventional hydrodesulfurization is that the process of the present invention does not require added hydrogen.

The process of the present invention is capable of removing any type of sulfur compound from a hydrocarbon stream, but it is particularly useful for removing the higher molecular weight organic sulfur compounds. Non-limiting examples of sulfur moieties contained in such feedstreams include elemental sulfur, as well as organically bound sulfur compounds such as aliphatic, naphthenic, and aromatic mercaptans, sulfides, di- and polysulfides, thiophenes and their higher homologs and analogs. Such analogs include the mono- and di-substituted condensed multi-ring dibenzothiophenes.

In one preferred embodiment, the present invention is practiced by passing the hydrocarbon stream containing organic sulfur through a bed of suitable Ni-containing adsorbent material. Ni-containing adsorbent materials suitable for use in the practice of the present invention are those containing from about 30 to about 90 wt. % Ni, preferably from about 50 wt. % to about 90 wt. % Ni, and more preferably from about 50 wt. % to about 70 wt. % Ni. It is preferred that the Ni be in a reduced state. That is, it is preferred that the Ni be in the metallic state during the instant adsorption process. The Ni-containing adsorbent material of the present invention will also have an effectively high surface area. That is, the surface area will be from about 200 to 400 $m^2/g$, preferably from about 220 to about 350 $m^2/g$, and more preferably from about 230 to about 300 $m^2/g$. Also, the nickel surface area should be greater than 20 $m^2/g$ based on dynamic $H_2$ chemisorption measurements. It is also preferred that the Ni-containing adsorbent material of the present invention contain an effective amount of an alkaline-earth metal oxide and an effective amount of one or more Group IVA oxides, preferably selected from $SiO_2$, $GeO_2$ or both. The preferred Group IVA oxide is $SiO_2$, By effective amount we mean that the adsorbent material will contain from about 5 to 20 wt. % of the Group IVA oxide and from about 1 to 10 wt. % of an alkaline-earth metal oxide, preferably MgO. It will be understood that if both $SiO_2$ and $GeO_2$ are present, then the total combination of both cannot exceed 20 wt. %. All weight percents are based on the total weight of the adsorbent. It is preferred that both be present. By effective amount we mean at least that amount that will cause an increase in the capacity of the adsorbent to absorb high molecular weight sulfur compounds by at least about 10%, preferably by at least about 15%, and more preferably by at least about 20%.

It is preferred that the sulfur-containing hydrocarbon stream be heated to the operating temperature of the adsorption stage prior to being introduced thereto. This temperature will be from about 100° C. to about 400° C., preferably from about 130° C. to about 350° C., and more preferably from about 200° to about 300° C.

It is also preferred that the sulfur-containing stream be introduced into the adsorption stage at a relatively low temperature and slowly increased in steps over a period of time to avoid reforming reactions. For example, it is preferred that the initial temperature of the adsorption stage be at 100° C. to about 150° C., more preferably from about 110° C. to about 140° C. and held there for an effective amount of time. That is, for an initial time period that is long enough for the adsorbent to adsorb sulfur on active sites which can also catalyze reforming reactions at higher temperatures. It is believed that the adsorption of sulfur compounds on these sites at the lower temperatures deactivates the sites for the higher-temperature reforming reactions. The amount of time spent at the lower operating temperature will vary, but on a commercial scale this time can range from about 4 days to about 10 days, preferably from about 5 days to about 8 days at end of which the temperature will be increased to 160-190 ° C. and held there for a second effective amount of time, which, for a commercial process unit, will typically range from about 1 to 5 days, preferably from about 2 to 4 days, after which the temperature will be increased to preferred adsorption temperatures in the range of about 200° C. to about 400° C., more preferably from about 210° C. to about 300° C., and most preferably from about 225° C. to about 300° C.

It was found by the inventors hereof that the freshly reduced Ni of the adsorbents of the present invention promotes undesirable reforming reactions by converting naphtheno-aromatics to multi-ring aromatics and producing hydrogen. Although the exact mechanism is unknown it is believed that this reforming reaction also reduces the sulfur adsorption capacity through competitive adsorption of the naphtheno-aromatics. In the sulfur adsorption process, the product sulfur concentration varies with time. The variation in product sulfur concentration is due to the presence of different sulfur species in the hydrocarbon feed having different affinity for the adsorbent. Since the sulfur capacity for the Ni adsorbent increases with operating temperature, a low start-of-run temperature minimizes the product sulfur giveaway at start-of-run when spare sulfur capacity is available. This in turn increases the adsorbent life and reduces the operating costs.

It will be understood that temperature ramping will be beneficial, not only for the Ni-based adsorbents of the present invention, but also for any other sulfur adsorbents that promote reforming. Non-limiting examples of such adsorbents include Group VIII metals, both supported and non-supported zeolites, alumina, silica gel, and carbons.

The following examples are illustrative of the invention and are not to be taken as limiting in any way.

EXAMPLE 1

Sulfur Uptake Capacity for Various Types of Adsorbents

FIG. 1 hereof compares the sulfur uptake of various adsorbent materials. The properties of Adsorbents A through E are shown in Table 1 below.

TABLE 1

Comparison of Chemical Properties of Adsorbents

| | Adsorbent A | Adsorbent B | Adsorbent C | Adsorbent D | Adsorbent E |
|---|---|---|---|---|---|
| Ni, wt % | 45 | 56 | 60 | 59 | 66 |
| $Al_2O_3$, wt % | 43 | 11 | 8 | 3 | 0 |
| MgO, wt % | 0 | 0 | 0 | 5 | 5 |
| $S_iO_2$, wt % | 0 | 12 | 8 | 17 | 11 |

TABLE 1-continued

Comparison of Chemical Properties of Adsorbents

| | Adsorbent A | Adsorbent B | Adsorbent C | Adsorbent D | Adsorbent E |
|---|---|---|---|---|---|
| BET Surface Area, $m^2/g$ | 166 | 185 | 160 | 260 | 260 |
| Ni Surface Area*, m2/g | 12 | | 32 | 54 | 64 |
| Crystallite Size, A° | 150 | | | 40 | 40 |

*Based on dynamic $H_2$ chemisorption

Table 2 below compares the sulfur uptake in terms of wt % sulfur per weight of the adsorbent at the same feed-to-adsorbent volume ratio (638), that is the volume of feed processed per volume of adsorbent. Adsorbent A was a 1/32" extrudate that was crushed and sieved through 16 and 35 mesh Tyler screens to obtain adsorbent particles ranging in size from 0.5 to 1.2 mm. Adsorbent E, on the other hand, was a powder. It was first pressed into pellets and then crushed and sieved through 16 and 35 mesh Tyler screens to obtain the adsorbent particles in the same size range as the particles of Adsorbent A. An equal volume (24.5 cc) of each adsorbent was loaded into a 1 foot×0.4 inch ID adsorber column. The adsorber-to-adsorbent particle diameter ratio was ~10 to minimize wall bypassing.

A forced-air convection oven was used to heat the adsorbent vessel containing the adsorbent. Prior to adsorption, each adsorbent was first reduced in hydrogen flowing at 4 scf/hr by step-wise heating up to 325° C. After the adsorbent was reduced, hydrogen was purged from the adsorber with nitrogen flowing at 4 scf/hr. The adsorber temperature was reduced to 225° C. while $N_2$ was flowing through the bed of adsorbent. Low sulfur diesel containing 42 wppm sulfur was pumped up-flow through the adsorber column at 20 cc/min to ensure that the adsorbent bed was flooded with feed. The space velocity, mass flux rate and residence time of the adsorber were 49 $hr^{-1}$, 6.0 usgpm/$ft^2$ and 1.2 minutes, respectively. An on-line sulfur analyzer was used to measure the total sulfur concentration in the effluent from the adsorber.

As shown in Table 2 below, the sulfur uptake of Adsorbent E, which contained magnesium and silica was three times higher than that of Adsorbent A, which did not contain magnesium and silica. As a result, the adsorbent life of Adsorbent E was three times longer than that of Adsorbent A.

TABLE 2

Comparison of Sulfur Capacity of Adsorbent A and Adsorbent E

| Adsorbent | Adsorbent A - (Comparative) | Adsorbent E |
|---|---|---|
| <10 wppm product, feed-to-adsorbent vol ratio | 0 | 400 |
| Sulfur Capacity*, wt % | 0.84 | 2.51 |
| Relative Sulfur Capacity# | 1 | 3 |
| Relative Life# | 1 | 3 |

Figure 2:
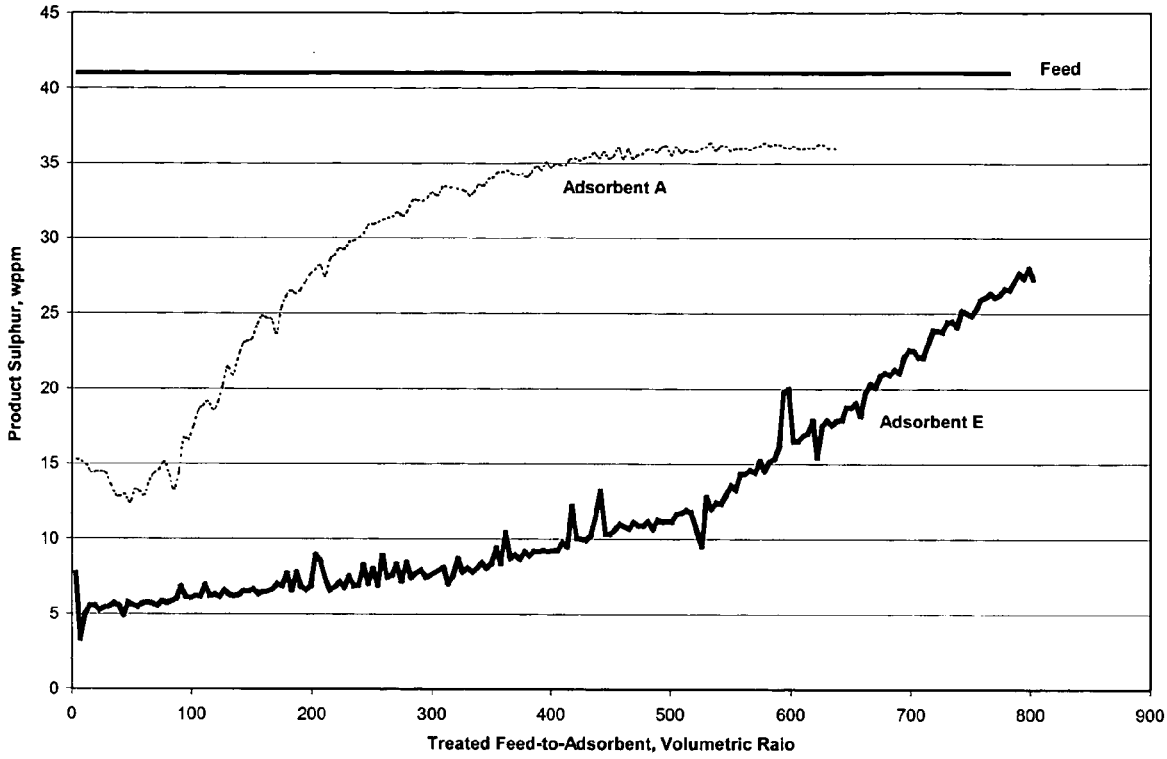
FIG. 2 hereof is a plot showing sulfur in treated product versus feed-to-adsorbent ratio for Adsorbent A and Adsorbent E of the example hereof.

*at an treated feed-to-adsorbent volumetric ratio of 638
#relative to Adsorbent A As expected from the higher sulfur uptake shown in Table 2, FIG. 2 hereof shows that Adsorbent E results in a considerably lower sulfur concentration in the adsorbent effluent. In fact, Adsorbent E can produce a product with <10 wppm total sulfur at a feed-to-adsorbent volumetric ratio of up to 400. On the other hand, Adsorbent A cannot achieve total product sulfur<12 wppm.

EXAMPLE 2

Figure 3:
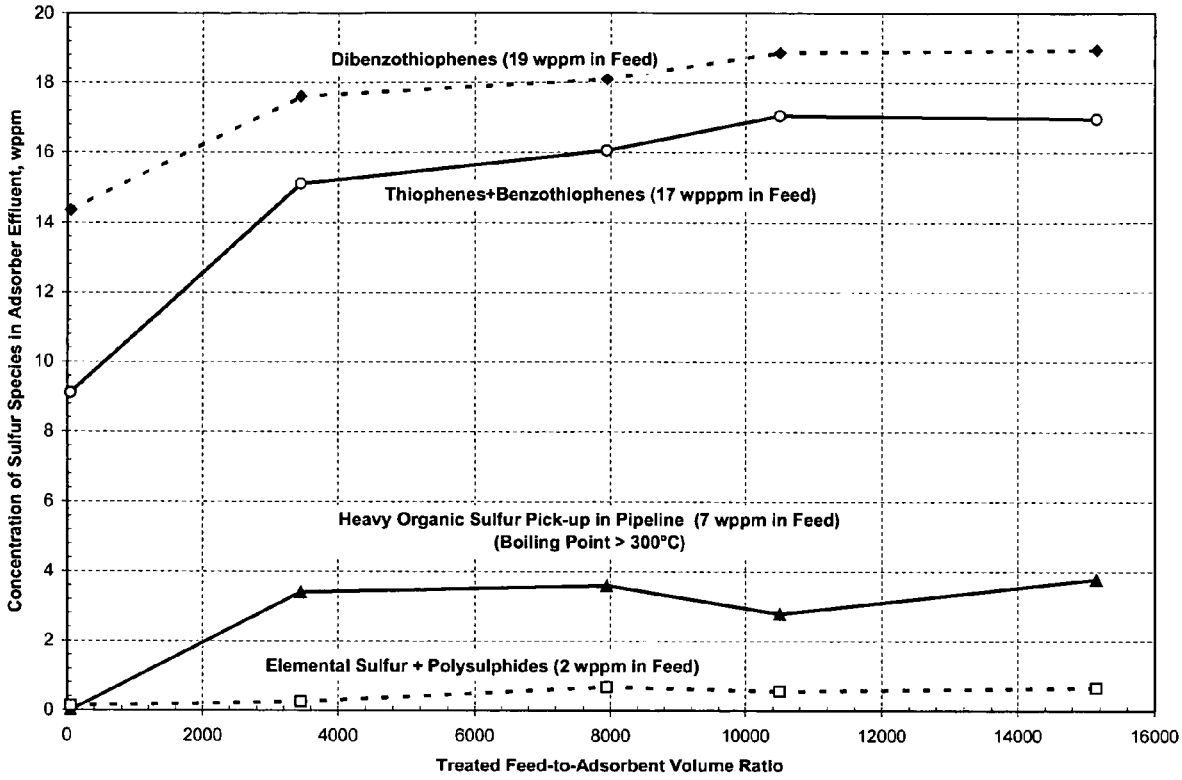
FIG. 3 hereof shows sulfur breakthrough curves for various types of sulfur.

Sulfur Adsorption Capacity Associated with High Molecular Weight Organic Sulfur Vs Other Sulfur Compounds FIG. 3 hereof shows the sulfur breakthrough curves associated with various sulfur compounds including high molecular weight (greater than about 200 since they have a boiling point greater than about 300° C.) sulfur compounds, that was picked up by a diesel feed when transported through a commercial pipeline. The total sulfur concentration in the diesel feed was 45 wppm while the concentration of the high MW organic sulfur picked-up in the pipeline by the diesel was 6.7 wppm. The sulfur concentration of individual sulfur species are shown in the plot of FIG. 3.

The adsorbent used in this experiment was Adsorbent E. As in Example 1, the adsorbent was crushed and sieved through 16 and 35 mesh Tyler screens and loaded into a 1 foot×0.4 inch ID adsorber. The adsorbent was then activated in flowing $N_2$ by heating it to 250° C. and then holding at 250° C. for 2 hours. The activation step is required in order to removed the $CO_2$ coating used to passivate the adsorbent. After activation the adsorber temperature was reduced to 225° C. and the feed was pumped up-flow through the adsorber column at 21 cc/min. The space velocity, mass flux rate and residence time of the adsorber were 154 $hr^{-1}$, 6.4 usgpm/$ft^2$ and 0.4 minutes, respectively. An on-line sulfur analyzer was used to measure the total sulfur concentration in the effluent from the adsorber. The concentrations of individual sulfur species was determined using a sulfur-specific gas chromatograph (GC) The concentration of the high MW organic sulfur species was determined by the difference of the total sulfur and diesel sulfur compounds in the 300° $C.^+$ fraction of the effluent samples.

FIG. 3 hereof shows that the high molecular weight pipeline organic sulfur concentration in the product is still considerably lower than its concentration in the feed (3.7 vs 6.7 wppm) at 15,000 treated feed-to-adsorbent volume ratio. This adsorption performance is comparable to that of elemental/polysulfide, which is has a high capacity on a Ni adsorbent. On the other hand, all other thiophenic compounds show complete breakthrough below the absorbent to feed volume ratio of 10,000. FIG. 3 clearly demonstrates that the ability of nickel adsorbents to remove sulphur compounds strongly depends on the type of sulphur species present in the feed.

Figure 4:
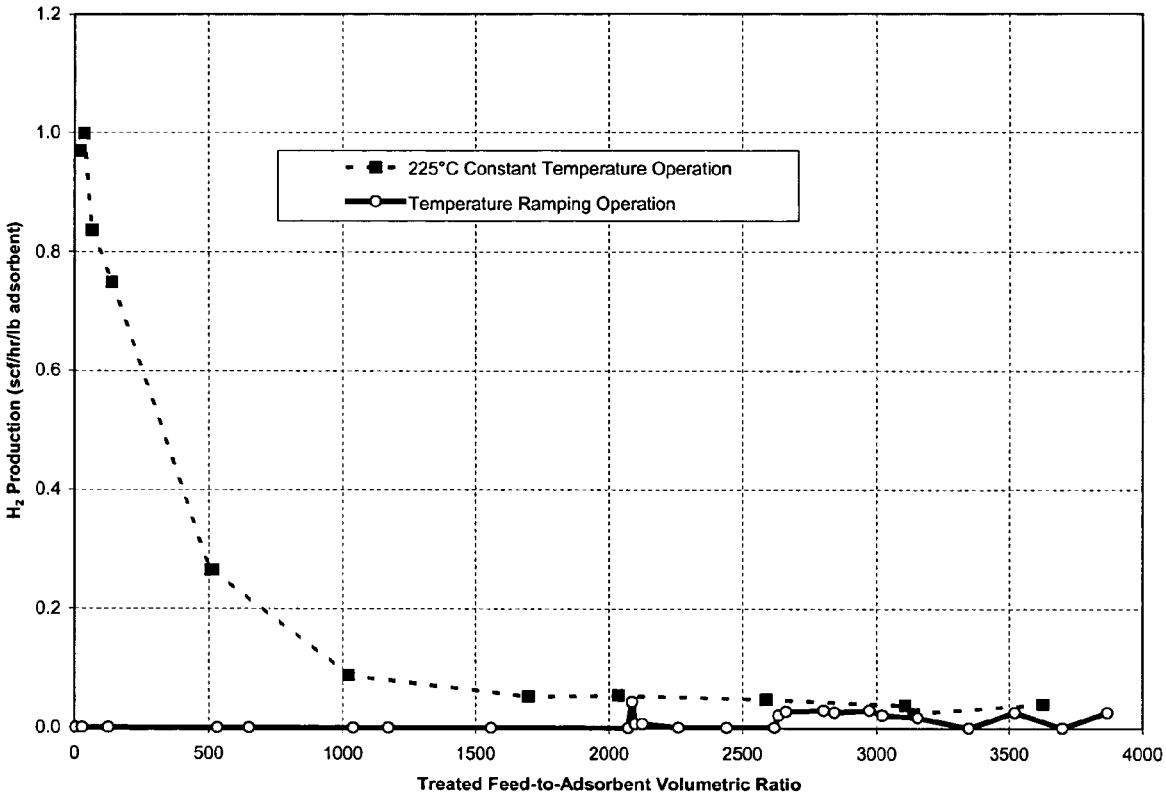
FIG. 4 hereof shows the beneficial effect of temperature ramping versus constant temperature during the adsorption process of the present invention.

FIG. 4 hereof shows the impact of temperature ramping vs a constant temperature operation at 225° C. on the $H_2$ gas make. The adsorbent used was Adsorbent E as described above, which had been activated in $N_2$ at 180° C. and then in $H_2$ at 250° C. for 2 hours. The feed used contained 47 wppm total sulfur and 29% total aromatics. The sulfur species present in the feed included benzothiophene, substituted dibenzothiophenes as well as 4.7 wppm of high molecular weight organic sulfur which was picked up in the commercial pipeline. As shown in FIG. 4, $H_2$ production was eliminated when the adsorber was started up at 130° C. whereas the 225° C. constant temperature operation produced significant amounts of $H_2$ up to the feed-to-adsorbent volume ratio of 500.

Figure 5:
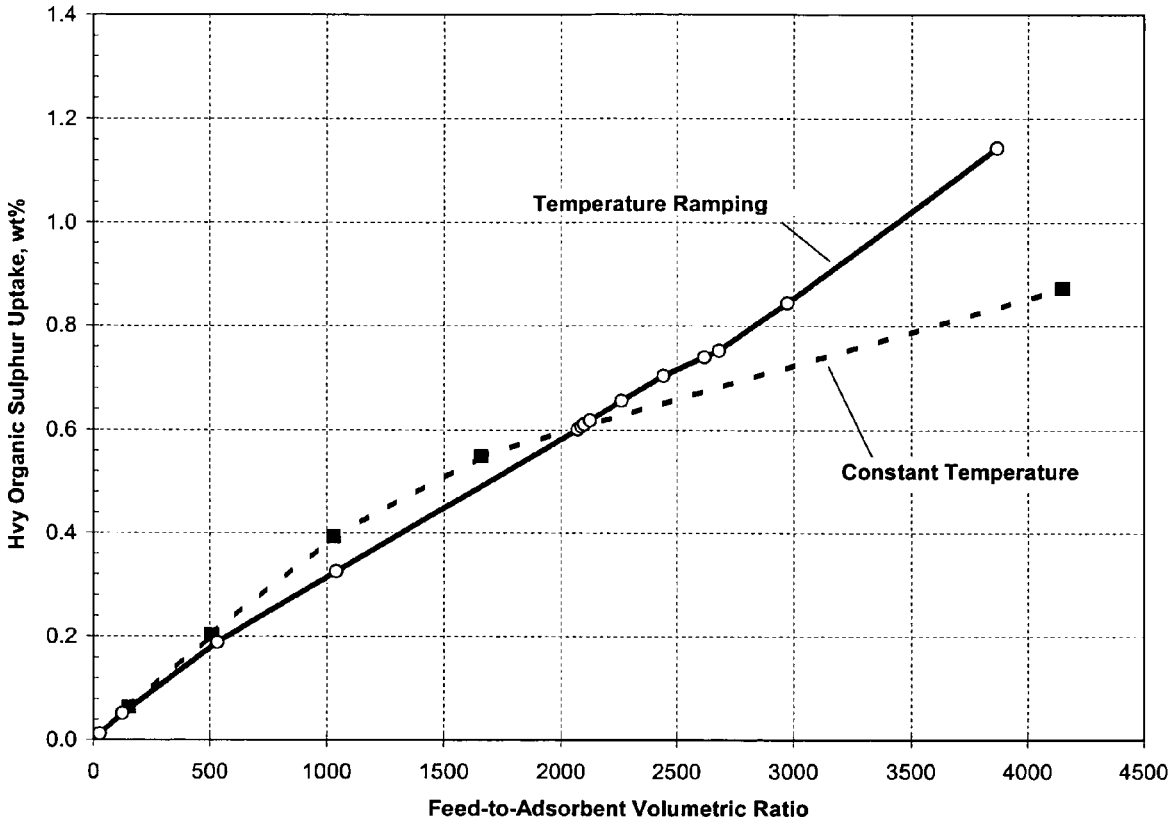
FIG. 5 hereof shows two plots comparing heavy organic sulfur uptake for constant temperature operation versus temperature ramping.

FIG. 5 hereof compares the uptake of the high molecular pipeline organic sulfur by Adsorbent D for temperature ramping and constant temperature operation. It is clear from the plot that at a feed-to-adsorbent ratio of 4000 the sulfur uptake of the high molecular weight organic sulfur species during the temperature ramping operation is unexpectedly higher than observed during the constant temperature operation. Although the exact mechanism is unknown it is believed that the lower sulfur uptake at the constant temperature operation of 225° C. compared to 130/180/225° C. temperature ramping run is due to the competitive adsorption of the naphtheno-aromatic and sulfur molecules on the adsorption sites. The adsorbed naphtheno-aromatics are reformed to produce multi-ring aromatics and $H_2$.

Figure 6:
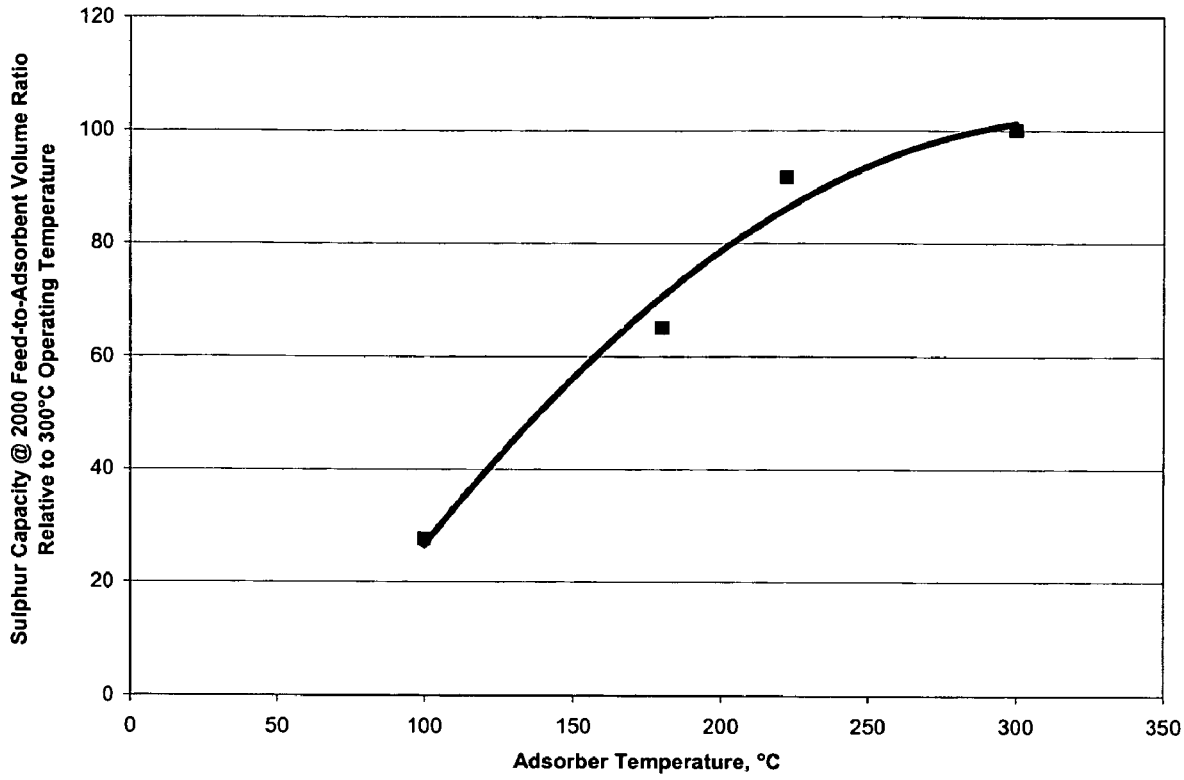
FIG. 6 hereof shows the impact of operating temperature of the adsorption process of the present invention on sulfur capacity at 300° C.

FIG. 6 hereof shows the impact of adsorber operating temperature on sulfur capacity relative to 300° C. The cumulative sulfur uptake was determined up to 2000 feed-to-adsorbent volume ratio. The plot clearly shows that the amount of sulfur uptake increases with operating temperature; for example, a two-fold increase in the sulfur capacity was observed when the operating temperature was increased from 100 to 300° C.

Figure 7:
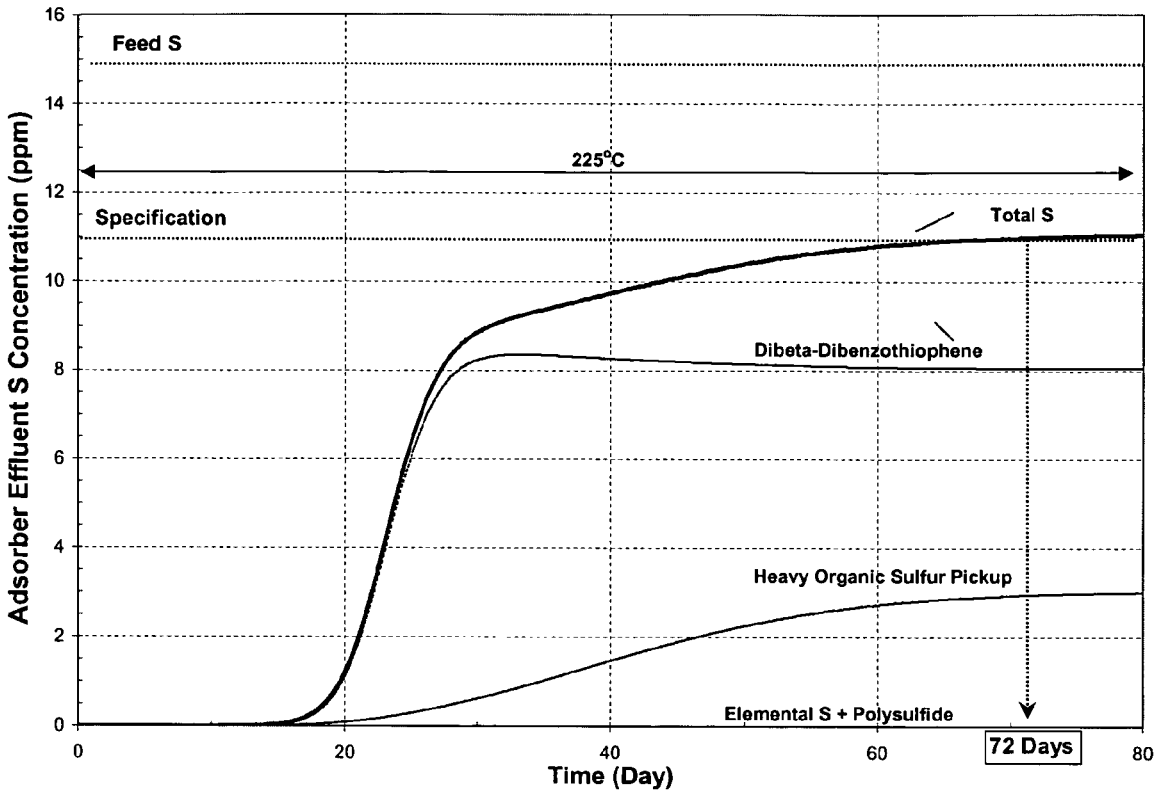
FIG. 7 hereof shows product sulfur breakthrough for adsorption operating at a constant temperature of 225° C.
Figure 8:
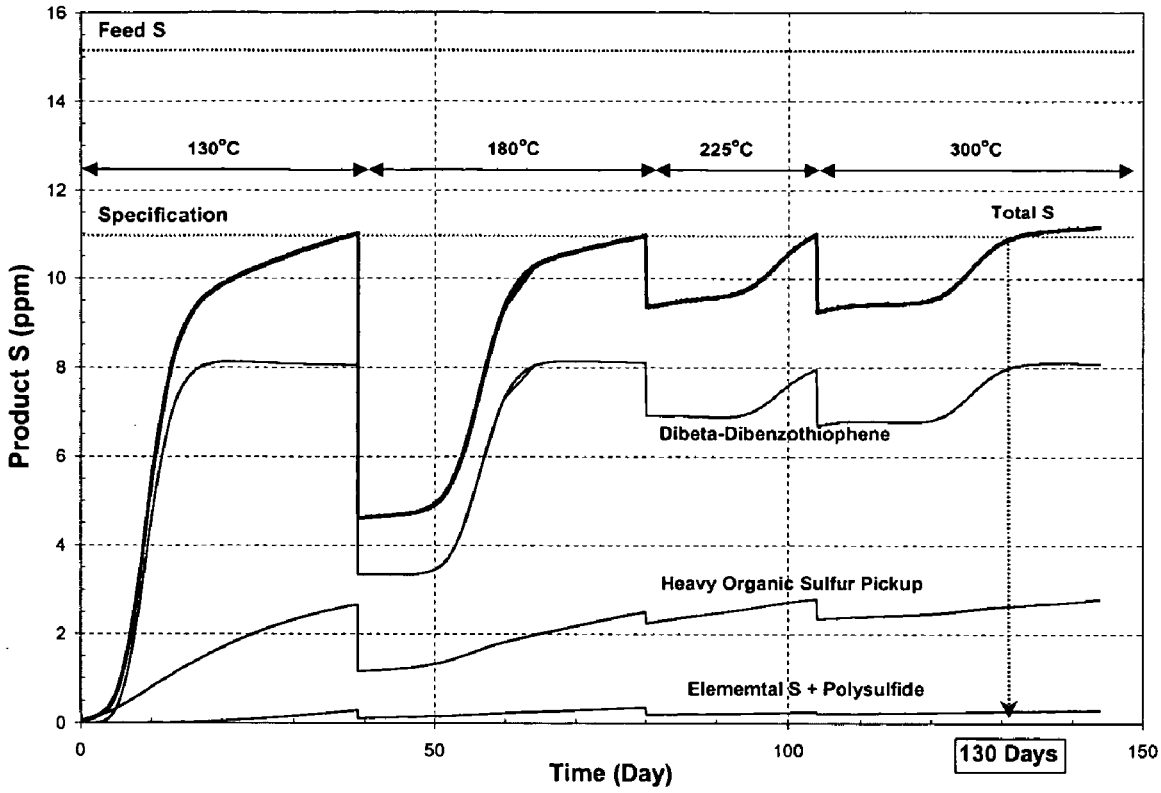
FIG. 8 hereof shows product sulfur breakthrough for adsorption operating with temperature ramping.

The adsorption kinetic model was developed using sulfur uptake data for different sulfur species at different temperatures and residence time. The model is used to illustrate how the temperature ramping operation can produce a near constant sulfur concentration in the adsorber effluent. FIG. 7 shows predicted product sulfur concentration as function of total treated feed-to-adsorbent volume ratio for the constant 225° C. operation. FIG. 8 shows the product sulfur concentration predicted for the temperature ramping operation where the temperature is increased step-wise from 130 to 300° C. The feed sulfur concentration is 15 ppm which consists of several different sulfur species including substituted dibenzothiophene, polysulfide and the high MW pipeline organic sulfur. To illustrate the benefit of the temperature ramping operation, the product sulfur specification is assumed to be 12 ppm. As shown by FIG. 7, the constant temperature operation over-achieves the product sulfur specification for a significant fraction of the run length, and the resulting run length is only 65 days. On the other hand, the temperature ramping operation minimizes the product sulfur give-away (over-achieving the product S specification) and extends the run length to 130 days.

The invention claimed is:

1. A process for removing high molecular weight organic sulfur species having a molecular weight of 200 and higher, from hydrocarbon streams by passing said hydrocarbon stream through a bed of adsorbent material, which adsorbent material has a Ni content from about 50 wt. % to about 90 wt. %, from about 5 to 20 wt. % of a Group IVA oxide selected from $SiO_2$ and $GeO_2$, from about 1 to 10 wt % of an alkaline-earth metal oxide, and contains substantially no aluminum compounds, wherein all weight percents are based on the total weight of the adsorbent, and which adsorbent has a BET surface area of about 200 $m^2/g$ to about 400 $m^2/g$ and a nickel surface area greater than 20 $m^2/g$ based on dynamic $H_2$ chemisorption, wherein passing said hydrocarbon stream through a bed of adsorbent material is performed in multiple temperature steps starting at a first temperature of about 100° C. to about 150° C. and increasing at an effective rate until a final temperature of about 200° C. to 400° C. is reached, the temperature is held at each step for an effective amount of time. and the temperature is held at the first temperature for about 4 to 10 days.

2. The process of claim 1, wherein the hydrocarbon stream is a distillate boiling range petroleum stream.

3. The process of claim 1, wherein the alkaline-earth metal oxide is MgO.

4. The process of claim 1, wherein the Group IVA oxide is $SiO_2$.

5. The process of claim 4, wherein the alkaline-earth metal oxide is MgO.

6. A process for removing high molecular weight organic sulfur compounds having a molecular weight of 200 and higher, from hydrocarbon streams by contacting said hydrocarbon stream with an adsorbent material, which adsorbent material has a Ni content from about 50 wt. % to about 90 wt. % and a surface area of about 200 $m^2/g$ to about 400 $m^2/g$, and contains substantially no aluminum compounds, wherein the contacting with the adsorbent material is performed in multiple temperature steps starting at about a first temperature about 100° C. and increasing at an effective rate until a final temperature of about 200° C. to 400° C. is reached, the temperature is held at each step for an effective amount of time, and the temperature is held at the first temperature for about 4 to 10 days.

7. The process of claim 6 wherein the hydrocarbon stream is a distillate boiling range petroleum stream.

8. The process of claim 6 wherein the Ni-containing adsorbent contains an effective amount of an alkaline-earth metal oxide and an effective amount of a Group IVA oxide.

9. The process of claim 8 wherein from about 1 to 10 wt. % of an alkaline-earth metal oxide is present and from about 5 to 20 wt. % of a Group IVA oxide, wherein the weight percents are based on the total weight of the adsorbent.

10. The process of claim 9 wherein the alkaline-earth metal oxide is MgO.

11. The process of claim 9 wherein the Group IVA oxide is SiO2.

* * * * *